US010153100B2

(12) United States Patent
Yen

(10) Patent No.: US 10,153,100 B2
(45) Date of Patent: Dec. 11, 2018

(54) KEY ASSEMBLY COMPRISING A METAL AND PLASTIC BALANCE LINK

(71) Applicants: LITE-ON ELECTRONICS (GUANGZHOU) LIMITED, Guangzhou (CN); LITE-ON TECHNOLOGY CORPORATION, Taipei (TW)

(72) Inventor: Ming-Fu Yen, Taipei (TW)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 0 days.

(21) Appl. No.: 15/367,375

(22) Filed: Dec. 2, 2016

(65) Prior Publication Data

US 2018/0025857 A1 Jan. 25, 2018

(30) Foreign Application Priority Data

Jul. 20, 2016 (TW) ..... 105122899 A

(51) Int. Cl.
*H01H 3/12* (2006.01)
*H01H 13/705* (2006.01)

(52) U.S. Cl.
CPC ..... *H01H 3/125* (2013.01); *H01H 3/122* (2013.01); *H01H 13/705* (2013.01); *H01H 2221/058* (2013.01); *H01H 2231/002* (2013.01)

(58) Field of Classification Search
CPC ..... H01H 3/22; H01H 2221/058; H01H 2221/062; H01H 13/705
USPC ..... 200/344
See application file for complete search history.

(56) References Cited

U.S. PATENT DOCUMENTS 5,823,325 A * 10/1998 Lin ..... H01H 3/125 200/344
9,455,097 B2 * 9/2016 Chen ..... H01H 3/125
2011/0303521 A1 * 12/2011 Niu ..... H01H 3/122 200/517

FOREIGN PATENT DOCUMENTS

| | | | |
|---|---|---|---|
| CN | 102779675 | A | 11/2012 |
| TW | M474242 | U | 3/2014 |
| TW | 201432757 | A | 8/2014 |
| TW | M500344 | U | 5/2015 |

* cited by examiner

*Primary Examiner* — Vanessa Girardi
(74) *Attorney, Agent, or Firm* — Li & Cai Intellectual Property (USA) Office

(57) ABSTRACT

A key assembly including a base plate, a keycap, and at least one balance link. The balance link is disposed between the base plate and the keycap, the balance link having a top lever and two side levers, wherein the two side levers being connected to the top lever at both ends thereof, two ends of the two side levers away from the top lever being connected to the base plate, the top lever being connected to the keycap. The top lever and/or the two side levers include a plastic portion, the parts of the top lever and the two side levers other that the plastic portion being made of metal such that the balance link is a composite structure. The balance link contacts at least one of the keycap and the base plate via the plastic portion.

7 Claims, 6 Drawing Sheets

KEY ASSEMBLY COMPRISING A METAL AND PLASTIC BALANCE LINK

BACKGROUND OF THE INVENTION

1. Field of the Invention

The instant disclosure relates to a key device and a balance link thereof; in particular, to a balance link structure applicable to keyboards or other input devices.

2. Description of Related Art

Due to the trend of making laptops smaller, the height of laptop keyboards is getting shorter, and yet the pressing distance of the keyboard keys is getting larger, causing the keys to tilt easily when being pressed. If a keyboard key tilts aside when being pressed, the connecting point located at the center of the key may fail to reach the base plate of the keyboard along with the pressed point, lowering the sensitivity of the keyboard.

Larger keys of a prior art keyboard are equipped with stabilizers which prevent the keys from tilting aside when being pressed so that the keys of larger sizes are as responsive as the smaller ones. A stabilizer of a key forms a stabilization mechanism with one end pivotally connected to the keycap and another end slidably connected to the base plate. When a stabilized key is pressed, the stabilizer slides relative to the base board and pivots relative to the keycap such that the keycap is kept parallel to the base board during the actuation and will not tilt aside.

However, the stabilization mechanism of a prior art computer keyboard has overly tight connection or overly loose connection among the keycap, the stabilizer, and the base plate, causing noises and excessively sensitive or insensitive actuation.

SUMMARY OF THE INVENTION

Accordingly, the object of the instant disclosure is to provide a key device and a balance link thereof acting as a stabilizer, in which the stabilizer is strengthened and kept from tilting aside, enhancing the sensitivity of the keyboard, providing accurate and mutant actuation of keyboard keys.

In order to achieve the aforementioned objects, according to an embodiment of the instant disclosure, a key assembly is provided, wherein the key assembly comprises a base plate, a keycap, and at least one balance link located between the base plate and the keycap, the at least one balance link including a top lever and two side levers, wherein the two side levers are connected to both ends of the top lever respectively, the ends of the two side levers that are away from the top lever being connected to the base plate, and the top lever being connected to the keycap, wherein the top lever and/or the two side levers have a plastic portion, the parts of the top lever and the two side levers other than the plastic portion being made of metal in such a manner that the at least one balance link is a composite structure. The at least one balance link is in contact with at least one of the keycap and the base plate via the plastic portion.

Another technical solution adopted by the instant disclosure is to provide a balance link for a key assembly, wherein the balance link comprising a top lever and two side levers, the two side levers being connected to both ends of the top lever respectively, wherein the top lever and/or the two side levers have a plastic portion, the parts of the top lever and the two side levers other than the plastic portion being made of metal in such a manner that the at least one balance link is a composite structure. The at least one balance link is in contact with at least one of a keycap and a base plate via the plastic portion.

The instant disclosure is advantageous in that the top lever and/or the two side levers have a plastic portion, the parts of the top lever and the two side levers other than the plastic portion being made of metal so that the at least one balance link is a composite structure, and the balance link is in contact with at least one of the keycap and the base plate via the plastic portion. The balance link being composed of both metal and plastic makes the balance link stronger that a prior art balance link so that the keycap will not flip over or tilt aside when being pressed. Hence, the key assembly of the instant disclosure has better sensitivity, and, since the balance link contacts at least one of the keycap and the base plate with the plastic portion, the connection between the balance link and the keycap and the connection between the balance link and the base plate will not be too tight or too loose, so the balance link can cooperate with the keycap and/or the base plate accurately.

Furthermore, since the balance link of the instant disclosure has both the properties of metal and of plastic, the actuations between the balance link and the keycap and between the balance link and the base plate are smooth and mutant. Moreover, the two side levers of the balance link can engage the base plate via a metal portion in combination with a plastic portion, the noises caused by the vibration in the keyboard while typing can be avoided.

In order to further the understanding regarding the instant disclosure, the following embodiments are provided along with illustrations to facilitate the disclosure of the instant disclosure.

DETAILED DESCRIPTION OF THE PREFERRED EMBODIMENTS

The aforementioned illustrations and following detailed descriptions are exemplary for the purpose of further explaining the scope of the instant disclosure. Other objectives and advantages related to the instant disclosure will be illustrated in the subsequent descriptions and appended drawings.

First Embodiment

Figure 1:
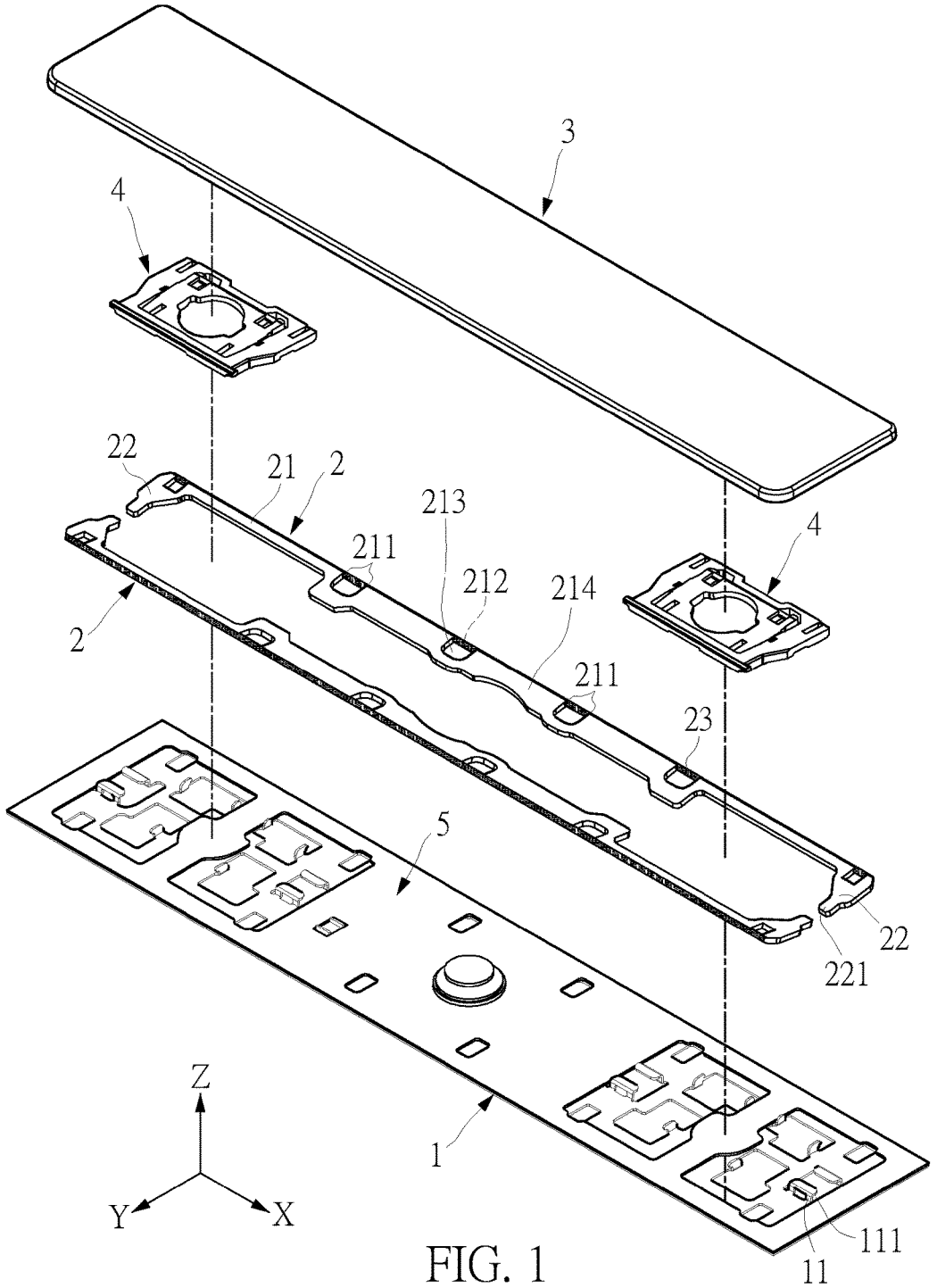
FIG. 1 is an perspective exploded view of a key assembly according to a first embodiment of the instant disclosure.
Figure 2:
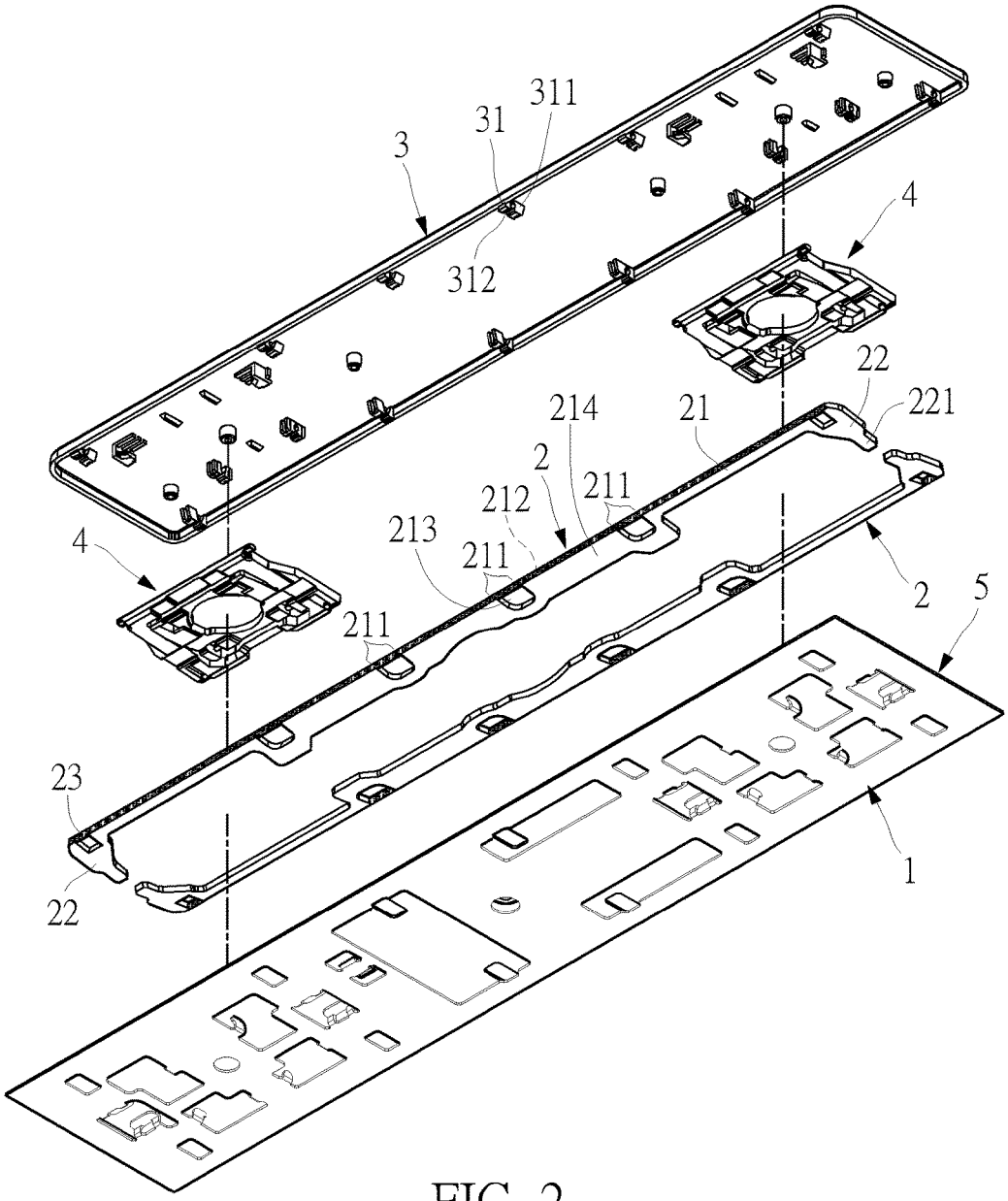
FIG. 2 is a perspective exploded view of the key assembly according to the first embodiment of the instant disclosure seen from another point of view.

Please refer to FIG. 1 and FIG. 2. The instant disclosure provides a key assembly applicable to a keyboard or other button devices. The key assembly includes a base plate 1, at least one balance link 2 or a keycap 3.

The base plate 1 is made of metal or other suitable materials. A scissor-shaped component 4 is disposed between the base plate 1 and the keycap 3, the scissor-shape component 4 acting as a double link mechanism guiding the vertical movement of the keycap 3 and transmitting the force exerted on the keycap 3 equally to every part of the key assembly. A conductive film 5 is disposed on the base plate 1. In the figures of the instant disclosure, the base plate 1 and the conductive film 5 are stacked together. In actual practices, a keyboard may include a plurality of key assemblies, wherein both the base plates 1 and the conductive films 5 are integrally formed.

There can be one or two balance links 2. The present embodiment discloses two balance links 2. However, the instant disclosure is not limited by the number of the balance links 2. The length of the balance link 2 corresponds to that of the keycap 3. The balance link 2 is disposed between the base plate 1 and the keycap 3, the upper portion of the balance link 2 being connected to the keycap 3, the lower portion of the balance link 2 being connected to the base plate 1. In the present embodiment, the upper portion of the balance link 2 is pivotally connected to the keycap 3, and the lower portion of the balance link 2 is slidably fitted to the base plate 1. However, the manner of connections between the balance link 2 and the base plate 1 and between the balance link 2 and the keycap 3 are not limited to the above-described; the manner of connections can be varied as needed. For example, the upper portion of the balance link 2 can be slidably fitted to the keycap 3, and the lower portion of the balance link 2 can be pivotally connected to the base plate 1.

Figure 3:
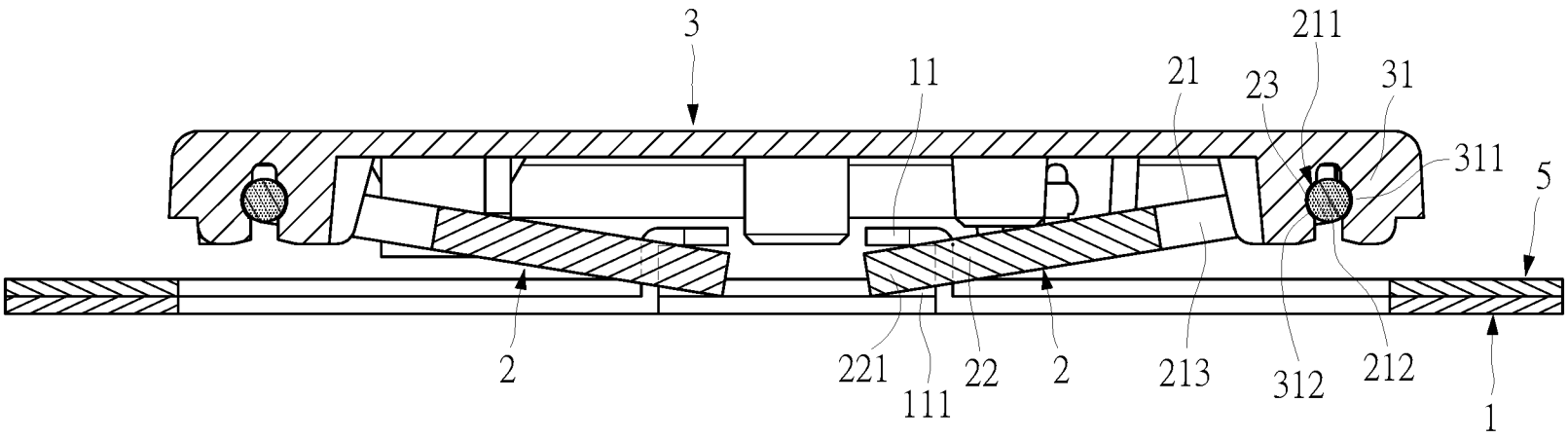
FIG. 3 is a side view of the key assembly according to the first embodiment of the instant disclosure.

The balance link 2 includes a top lever 21 and two side levers 22. The top lever 21 and the two side levers 22 are board-shaped. Specifically, the top lever 21 is an elongated board, the two side levers 22 being connected to both ends of the top lever 21 and extending downward therefrom such that the two side levers 22 protrude from the lower edge of the top lever 21 so the balance link 2 is approximately U-shaped. As shown in FIG. 3, the ends of the two side levers 22 that are away from the top lever 21 are connected to the base plate 1, and the top lever 21 of the balance link 2 is connected to the keycap 3. The top lever 21 and/or the two side levers 22 have a plastic portion 23, and the parts of the top lever 21 and the two side levers 22 other than the plastic portion are made of metal such that the at least one balance link is a composite structure. The metal part of the top lever 21 and the two side levers 22 can be made by stamping metal powder or metal blanks. The balance link 2 is in contact with at least one of the keycap 3 and the base plate 1 via the plastic portion.

Specifically, the end of each side lever 22 that is away from the top lever 21 includes a first slide-fit portion 221. The instant disclosure is not limited by the structure of the first slide-fit portion 221. In the present embodiment, the first slide-fit portion 221 is a strip body protruding from one end of the side lever 22, the width of the first slide-fit portion 221 being narrower than that of the side lever 22. The top lever 21 includes at least one first pivot portion 211 at the top portion thereof. The instant disclosure is not limited by the structure of the first pivot portion 211. In the present embodiment, the top lever 21 includes a plurality of the first pivot portions 211 at the top portion thereof, each first pivot portion 211 including a pivot shaft 212, in which the pivot shafts 212 are connected to each other. Furthermore, the top lever 21 includes a through hole 213 located near each pivot shaft 212. In the present embodiment, the top lever 21 includes the plastic portion 23 that is formed into the first pivot portion 211, that is, the plastic portion 23 can be formed into the pivot shaft 212. The plastic portion 23 can be formed into the whole surface of the pivot shaft 212, or be formed into part of the pivot shaft 212. For example, the plastic portion 23 can be formed on the surface of the pivot shaft 212 or as a segment of the pivot shaft 212. Therefore, the plastic portion 23 can be formed into the part of the pivot shaft 212 that will be in contact with the keycap 3. In the present embodiment, the plastic portion 23 is formed into the whole pivot shaft 212, and each pivot shaft 212 is connected to one another. Moreover, the width of the middle portion of top lever 21 can be larger or equal to that of both end portions of the top lever 21 in a manner such that the wider portion acting as a reinforcing portion 214 can strengthen the top lever 21.

Moreover, the base plate 1 can include a second slide-fit portion 11 corresponding to the first slide-fit portion 221. The instant disclosure is not limited by the structure of the second slide-fit portion 11. In the present embodiment, the second slide-fit portion 11 can be an L-shaped strip and can include a groove 111. The first slide-fit portion 221 of the balance link 2 can be slidably fitted to the corresponding second slide-fit portion 11, that is to say, the first pivot portion 211 can be disposed in the groove 111 so that the lower portion of the balance link 2 can be slidably connected to the base plate 1. The first pivot portion 211 can slide within the second slide-fit portion 11 back and forth, i.e. slide in the Y direction as shown in FIG. 1. In another embodiment, the structures of the first pivot portion 211 and the second slide-fit portion 11 can switch, or other slide-fit structure can replace the structure of the first pivot portion 211 and the second slide-fit portion 11.

The keycap 3 includes a second pivot portion 31 corresponding to the first pivot portion 211, wherein the second pivot portion 31 and the keycap 3 are integrally formed. The second pivot portion 31 can be disposed at the edge of the keycap 3. The instant disclosure is not limited by the structure of the second pivot portion 31. In the present embodiment, the keycap 3 includes a plurality of the second pivot portions 31, each second pivot portion 31 including a support member 311 protruding from the bottom surface of the keycap 3 and a pivot hole 312 disposed in the support member 311. The first pivot portion 211 of the side lever 22 can be pivotally connected to the corresponding pivot hole 312 so that the upper portion of the balance link 2 can be pivotally connected to the keycap 3. Furthermore, each support member 311 can be fitted to each through hole 213 so that the connection between the balance link 2 and the keycap 3 is stronger. In another embodiment, the structure of the first pivot portion 211 and that of the second pivot portion 31 can switch, or other pivot-connection structure can replace the structure of the first pivot portion 211 and that of the second pivot portion 31.

With the balance link 2 acting as a balance mechanism, when the key assembly is pressed, the force exerted on the keycap 3 is transmitted equally to the whole keycap 3 such that the keycap 3 is kept parallel to the base plate 1 during the actuation and will not tilt aside, which lowers the sensitivity of the key assembly. The balance link 2 helps facilitate the pressing of the key assembly on the left or right portion thereof, i.e. the actuation in the X direction as shown in FIG. 1.

Second Embodiment

Figure 4:
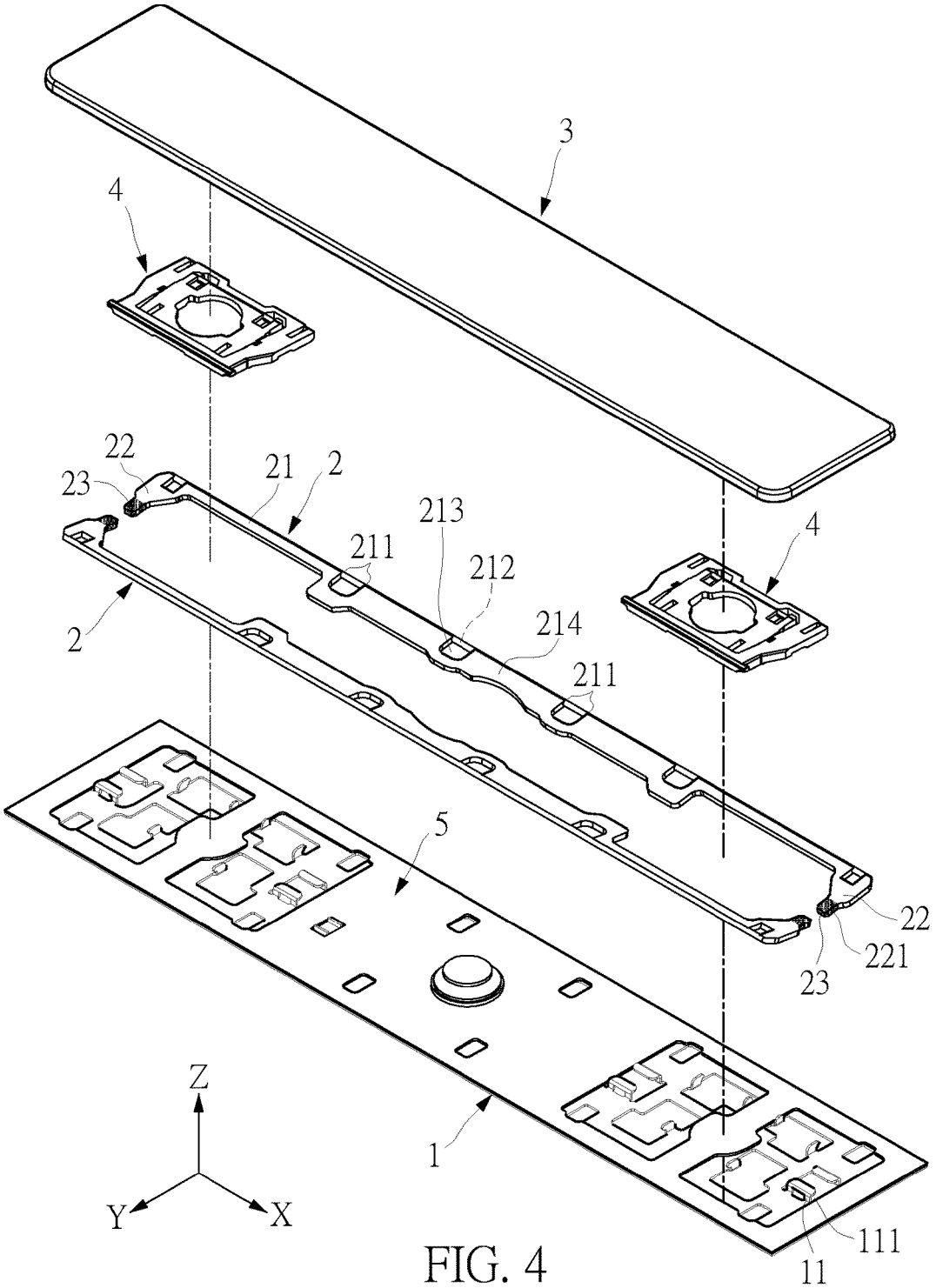
FIG. 4 is a perspective exploded view of a key assembly according to a second embodiment of the instant disclosure.
Figure 5:
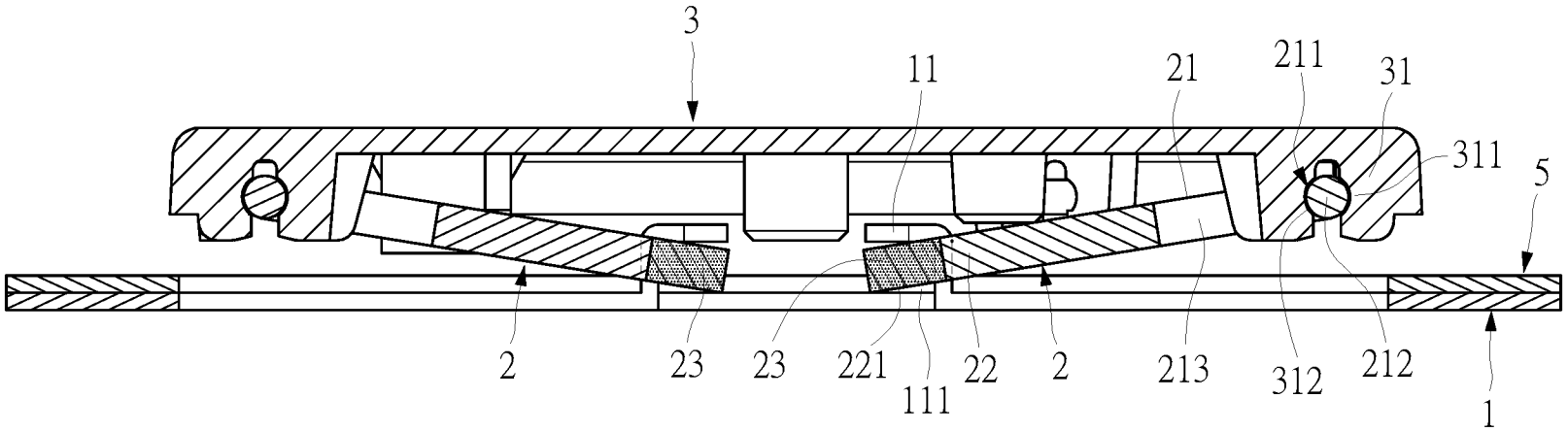
FIG. 5 is a side view of the key assembly according to the second embodiment of the instant disclosure.

Please refer to FIG. 4 or FIG. 5. The difference between the present embodiment and the first embodiment is that, in the present embodiment, the balance link 2 includes the plastic portion 23 that is formed into the first slide-fit portion 221. The plastic portion 23 can be formed into the whole first slide-fit portion 221, or be formed into part of the first slide-fit portion 221, such as the surface thereof. The structure and the way of actuation of the present embodiment are similar to that of the first embodiment, so will not be further described hereinafter.

Third Embodiment

Figure 6:
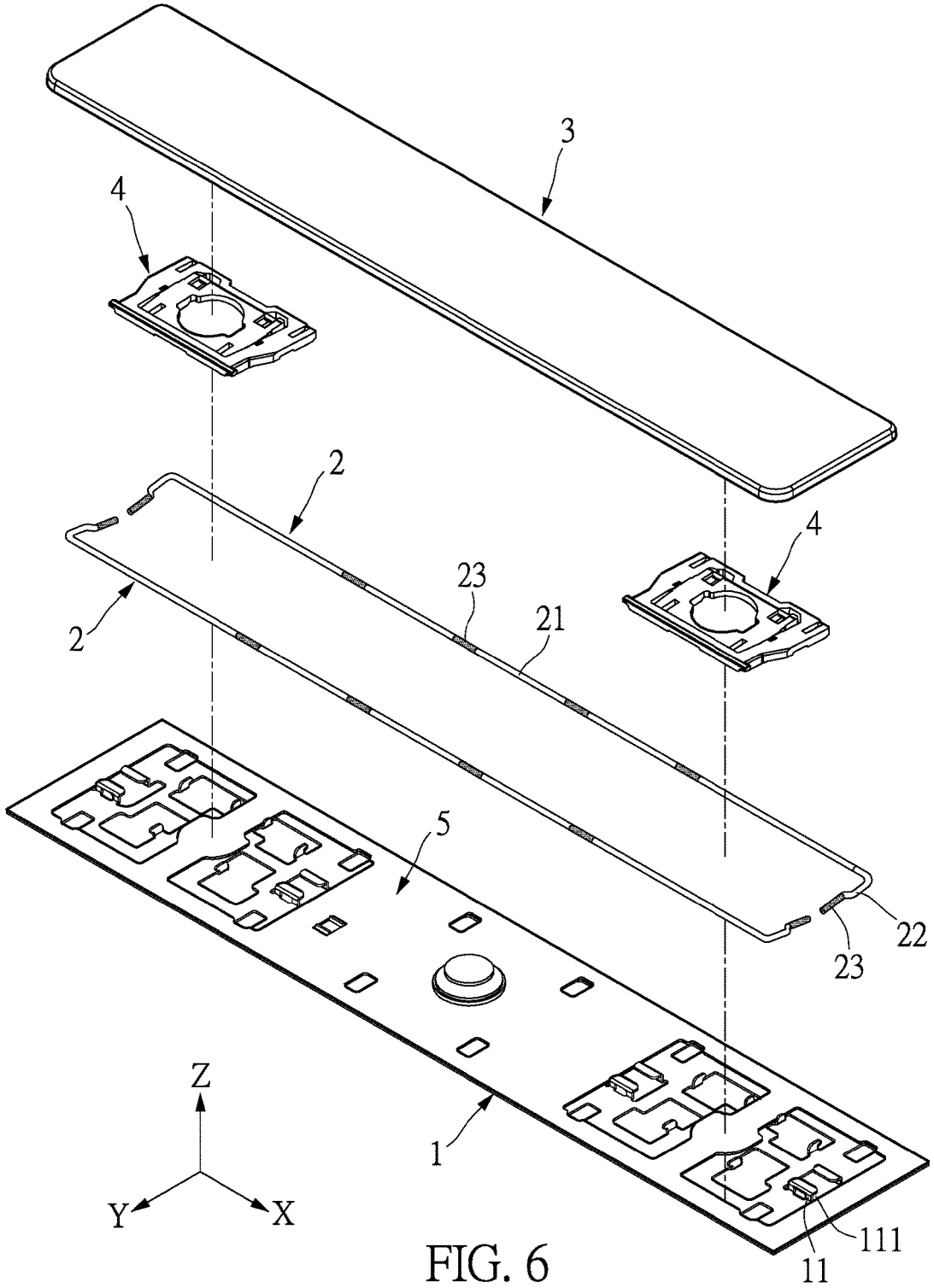
FIG. 6 is a perspective exploded view of a key assembly according to a third embodiment of the instant disclosure.

Please refer to FIG. 6. The balance link 2 is disposed between the base plate 1 and the keycap 3. The balance link 2 includes a top lever 21 and two side levers 22, the two side levers 22 being connected to both ends of the top lever 21, the ends of the side lever 22 away from the top lever 21 being connected to the base plate 1, and the top lever 21 being connected to keycap 3. The top lever 21 and/or the two side lever 22 include a plastic portion 23 in such a manner that the balance link 2 is a composite structure. The balance link 2 is in contact with at least one of the keycap 3 and the base plate 1 via the plastic portion 23. In the present embodiment, both the top lever 21 and the two side lever 22 include the plastic portion 23, and the top lever 21 and the two side levers 22 are in the shape of a circular cylindrical rod.

The instant disclosure provides a key assembly comprising a balance link, of which the top lever and/or the two side levers include a plastic portion, the part of the top lever and the part of the two side levers other than the plastic portion being made of metal such that balance link is a composite structure. The balance link contacts at least one of the base plate and/or the keycap via the plastic portion. The balance link of the instant disclosure consisting of both metal material and plastic material makes the key assembly of the instant disclosure have a stronger structure than a prior art key device so that the keycap will not flip over or tilt aside when being pressed. Accordingly, the key assembly of the instant disclosure has better sensitivity, and, since the balance link contacts at least one of the keycap and the base plate with the plastic portion, the connection between the balance link and the keycap and the connection between the balance link and the base plate will not be too tight or too loose, so the balance link can cooperate with the keycap and/or the base plate accurately.

Furthermore, since the balance link of the instant disclosure has both the properties of metal and of plastic, the actuations between the balance link and the keycap and between the balance link and the base plate are smooth and mutant. Moreover, the two side levers of the balance link can engage the base plate via a metal portion in combination with a plastic portion, the noises caused by the vibration in the keyboard while typing can be avoided.

The descriptions illustrated supra set forth simply the preferred embodiments of the instant disclosure; however, the characteristics of the instant disclosure are by no means restricted thereto. All changes, alterations, or modifications conveniently considered by those skilled in the art are deemed to be encompassed within the scope of the instant disclosure delineated by the following claims.

What is claimed is:

1. A key assembly, comprising:

a base plate;

a keycap; and at least one balance link located between the base plate and the keycap, the at least one balance link including a top lever and two side levers, wherein the two side levers are connected to both ends of the top lever respectively, ends of the two side levers that are away from the top lever are connected to the base plate, and the top lever is connected to the keycap;

wherein the top lever and/or the two side levers have a plastic portion for respectively being engaged with the keycap and the base plate, and the part of the top lever and the part of the two side levers other than the plastic portion are made of metal in such a manner that the at least one balance link is a composite structure;

wherein the at least one balance link is in contact with at least one of the keycap and the base plate via the plastic portion; and wherein the top lever includes a plurality of first pivot portions and the plastic portion that is formed into the first pivot portions, each of the first pivot portions includes a cylindrical pivot shaft, the cylindrical pivot shafts are connected to each other, the top lever includes a through hole located near each cylindrical pivot shaft, wherein the keycap includes a plurality of second pivot portions respectively corresponding to the first pivot portions, each of the second pivot portions includes a support member and a pivot hole, the support member protrudes from the keycap and corresponds to the through hole, and the pivot hole is disposed in the support member and corresponds to the cylindrical pivot shafts, each cylindrical pivot shaft is pivotally connected to each corresponding pivot hole of the second pivot portions, and each support member is received by each corresponding through hole of the top lever.

2. The key assembly according to claim 1, wherein the first pivot portions are pivotally connected to the second pivot portions.

3. The key assembly according to claim 1, wherein the two side levers each include a slide-fit portion at the ends thereof that are away from the top lever, the two side levers includes the plastic portion that is formed into the first slide-fit portions, and the base plate includes two second slide-fit portions corresponding to the first slide-fit portions respectively in a manner such that the first slide-fit portions is slidably fitted to the second slide-fit portions.

4. The key assembly according to claim 1, wherein the top lever has a reinforcing portion at a center part thereof.

5. A balance link for a key assembly, the balance link comprising a top lever and two side levers, the two side levers being connected to both ends of the top lever respectively, wherein the top lever and/or the two side levers have a plastic portion for respectively being engaged with a keycap and a base plate, and the other part of the top lever and the two side levers other than the plastic portion is made of metal in such a manner that the balance link is a composite structure;

wherein the balance link is in contact with at least one of the keycap and the base plate via the plastic portion; and wherein the top lever includes a plurality of first pivot portions, each first pivot portion includes a cylindrical pivot shaft, the cylindrical pivot shafts are connected to each other, and the top lever has a through hole located near each cylindrical pivot shaft.

6. The balance link for the key assembly according to claim 5, wherein the two side levers each include a slide-fit portion located at ends thereof that are away from the top lever, and the two side levers include the plastic portion that is formed into the slide-fit portions.

7. The balance link for a key assembly according to claim 5, wherein the top lever has a reinforcing portion at a center part thereof.

* * * * *